US007298998B1

(12) United States Patent
Tooker et al.

(10) Patent No.: US 7,298,998 B1
(45) Date of Patent: Nov. 20, 2007

(54) IMAGE REGISTRATION CONTROL UTILIZING REAL TIME IMAGE SYNCHRONIZATION

(75) Inventors: Ana P. Tooker, Penfield, NY (US); David M. Kerxhalli, Rochester, NY (US); Thomas M. Baretsky, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/426,495

(22) Filed: Jun. 26, 2006

(51) Int. Cl.
*G03G 15/01* (2006.01)

(52) U.S. Cl. ..... 399/301; 399/302

(58) Field of Classification Search ..... 399/301, 399/302

See application file for complete search history.

(56) References Cited

U.S. PATENT DOCUMENTS 6,181,887 B1 1/2001 Hughes et al.
6,498,913 B1 12/2002 Tooker et al.
6,804,485 B2 10/2004 Martin et al.
6,903,758 B1 6/2005 Kerxhalli et al.
2005/0042001 A1 * 2/2005 Shinohara et al. ..... 399/301

* cited by examiner

*Primary Examiner*—David M. Gray
*Assistant Examiner*—Bryan Ready
(74) *Attorney, Agent, or Firm*—Oliff & Berridge, PLC

(57) ABSTRACT

A system and method to control imaging devices in a single-pass multi-color electrophotographic printing machine that includes a photoconductive member having a timing aperture, the photoconductive member moving along a path in the printing machine, and a plurality of imaging devices, each one of the plurality of imaging devices writing a latent image on the photoconductive member. The system further includes a sensor, located adjacent the photoconductive member, to sense the aperture in the photoconductive member as it passes the sensor and generate a signal indicative thereof and a control device and method that provides a timing signal for each of the plurality of imaging devices based on the signal generated by the sensor and a clock signal that is synchronous for all of the imaging devices.

20 Claims, 3 Drawing Sheets

IMAGE REGISTRATION CONTROL UTILIZING REAL TIME IMAGE SYNCHRONIZATION

BACKGROUND

This disclosure relates generally to control systems and methods for an electrophotographic printing machine and, more particularly, concerns systems and methods for registering different color component images of a multi-color image.

In a typical electrophotographic printing process, a photoconductive member is charged to a substantially uniform potential so as to sensitize the surface of the photoconductive member. The charged portion of the photoconductive member is exposed to a light image of an original document being reproduced. Exposure of the charged photoconductive member selectively dissipates the charges in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material includes toner particles adhering triboelectrically to carrier granules. The toner particles are attracted from the carrier granules to the latent image so as to form a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture that includes a plurality of image forming stations. One example of the plural image forming station architecture utilizes an image-on-image (IOI) system in which a photoreceptive member (photoreceptor) is recharged, reimaged and developed for each color separation (each color component of the multi-color image). This charging, imaging, developing and recharging, reimaging and developing, all followed by transfer to paper, is done in a single revolution of the photoreceptor in so-called single-pass machines, while multipass architectures form each color separation with a single charge, image and develop, with separate transfer operations for each color.

In single-pass color machines and other high speed printers, it is desirable to utilize as much of the surface area of the photoreceptor as possible to improve the efficiency and print speed of the printer. The photoreceptor typically is a belt that has a seam which is an area of the photoreceptor that is unusable for forming images thereon. A standard way of marking the seam is to have a hole located at a known distance therefrom and to trigger image formation from that hole. Many print jobs, however, vary in the size of media used, and it is therefore desirable to utilize the photoreceptor in what is known as a variable pitch mode. It is further desirable to utilize this variable pitch mode without having to change the photoreceptor belt to vary the pitch number for the particular print job.

A control system and method for controlling an imaging device in a single-pass multi-color electrophotographic printing machine has been described in U.S. Pat. No. 6,181,887, the disclosure of which is incorporated herein by reference in its entirety. In such electrophotographic printing machines, a belt hole sensor detects the passage of a timing aperture that identifies the location of the seam in a photoreceptor belt. After identifying the location of the seam, a controller calculates image areas where images can be placed on the belt by sequentially-placed imaging stations so as to align images placed by different imaging stations, and to avoid the placement of an image on the seam. In U.S. Pat. No. 6,181,887, the images are formed in relation to a series of "virtual holes" representing positions along the length of the belt. The movement of the belt corresponds with (and is tracked by) an encoder that provides a series of regularly spaced encoder counts or signals indicating the incremental movement of the belt. For example, the encoder is disposed on a roller about which the photoreceptor belt is mounted, and as the roller rotates due to belt movement, the encoder outputs pulses defining the encoder signal. After the belt has moved a predetermined distance, a signal is provided to the appropriate imaging station to cause the imaging station to form an image on the belt.

Typical in such systems and methods, when the timing aperture is detected by the belt hole sensor, the next output encoder count is established as the reference point for the belt seam. Each virtual belt hole is based on this reference point, with the placement of the virtual belt holes in relation to the belt determined from the number of encoder counts output after the reference point encoder count. After a specific number of encoder counts are output, the first virtual hole is representatively identified on the belt and a first image initiation signal is provided by the controller to the first imaging station to initiate the formation of an image containing the first color component by that first imaging station on the belt. After the output of an additional number of encoder counts, the first virtual hole is deemed to be positioned near the second imaging station, and therefore a second image initiation signal is provided to the second imaging station by the controller to cause the formation of an image containing the second color component by the second imaging station on the belt. This process is repeated for the remaining imaging stations until each imaging station forms its color component image juxtaposed with the color component image of the other stations for a particular image. The multicolor toner image then is transferred to the copy sheet and fused.

The aforementioned system and method, however, are limited because the encoder is not synchronous with the imaging stations. In the aforementioned systems and methods, the motors in the imaging stations are controlled through the use of a Master Clock providing a Master Clock signal. The Master Clock signal is not synchronous with the encoder signal corresponding to the movement of the photoreceptor belt. As described above, the image initiation signals sent to the imaging stations are based on the encoder signal. Accordingly, the imaging stations receive image initiation signals at times that are not synchronized with the signal from the Master Clock. Thus, when an imaging station receives an image initiation signal, it must compensate for the asynchronicity between that signal and the clock signal, thus producing a delay between receipt of the image initiation signal and the actual initiation of the image formation process by the imaging station. A delay occurs with each imaging station, but to different degrees because the image initiation signals are received by the imaging stations at varying times between consecutive clock counts.

The aforementioned delays detrimentally affect the operation of electrophotographic printing machines. For each imaging station, the delay causes error in the precise location of the image at the point on the belt corresponding to a virtual hole.

To compensate for the aforementioned delay, some systems have modified the operation of the imaging device to more closely coincide with the image initiation signal. This modification is generally done by using reference marks or chevrons just before the image areas on the photoreceptor belt and by the speeding up and slowing down of each of the motors driving the imaging stations to cause the respective imaging operations to more closely coincide with the image initiation signals, a process also referred to as "rephase." However, this modification interferes with the placement of chevrons in any inter-image area in which rephase is occurring, because the image is positionally unstable during rephase and because the image initiation signal is asynchronous to the Master Clock. To minimize this instability, an additional zone is required on the photoreceptor belt for the formation of chevrons.

The efficiency of such electrophotographic printing machines is reduced because the requirement for a dedicated zone for the formation of chevrons limits the maximum number of image areas that can be formed in each cycle of the photoreceptor belt. The time required to adjust motor phase also limits the minimum inter-image area size, and further limits the efficiency of the electrophotographic printing machine.

SUMMARY

In accordance with one aspect of the disclosure, there is provided a system for controlling imaging devices in a single-pass multi-color electrophotographic printing machine including a photoconductive member having a timing member, the photoconductive member moving along a path in the printing machine, and a plurality of imaging devices with each one of the plurality of imaging devices forming a latent image on the photoconductive member when provided a timing signal. The system further includes a sensor to sense the timing member in the photoconductive member as the timing member passes the sensor and to generate a sensor signal. In addition, the system further includes a controller that generates the timing signal for each of the plurality of imaging devices based on the sensor signal and a clock signal generated by a clock or by another device generating a predictable signal, such as a signal provided by a ROS.

In accordance with yet another aspect of the disclosure there is provided a method for controlling imaging devices in a single-pass multi-color electrographic printing machine, including sensing a timing member in a photoconductive member moving along a path in the printing machine to generate a sensor signal, generating a timing signal for each of a plurality of imaging devices of the printing machine based on the sensor signal and a clock signal generated by a clock or by another device generating a predictable signal, such as a signal provided by a ROS, and the plurality of imaging devices forming latent images on the photoconductive member when provided the timing signal.

BRIEF DESCRIPTION OF THE DRAWINGS

Other features of the present disclosure will become apparent as the following description proceeds and upon reference to the drawings, in which.

EMBODIMENTS

Figure 1:
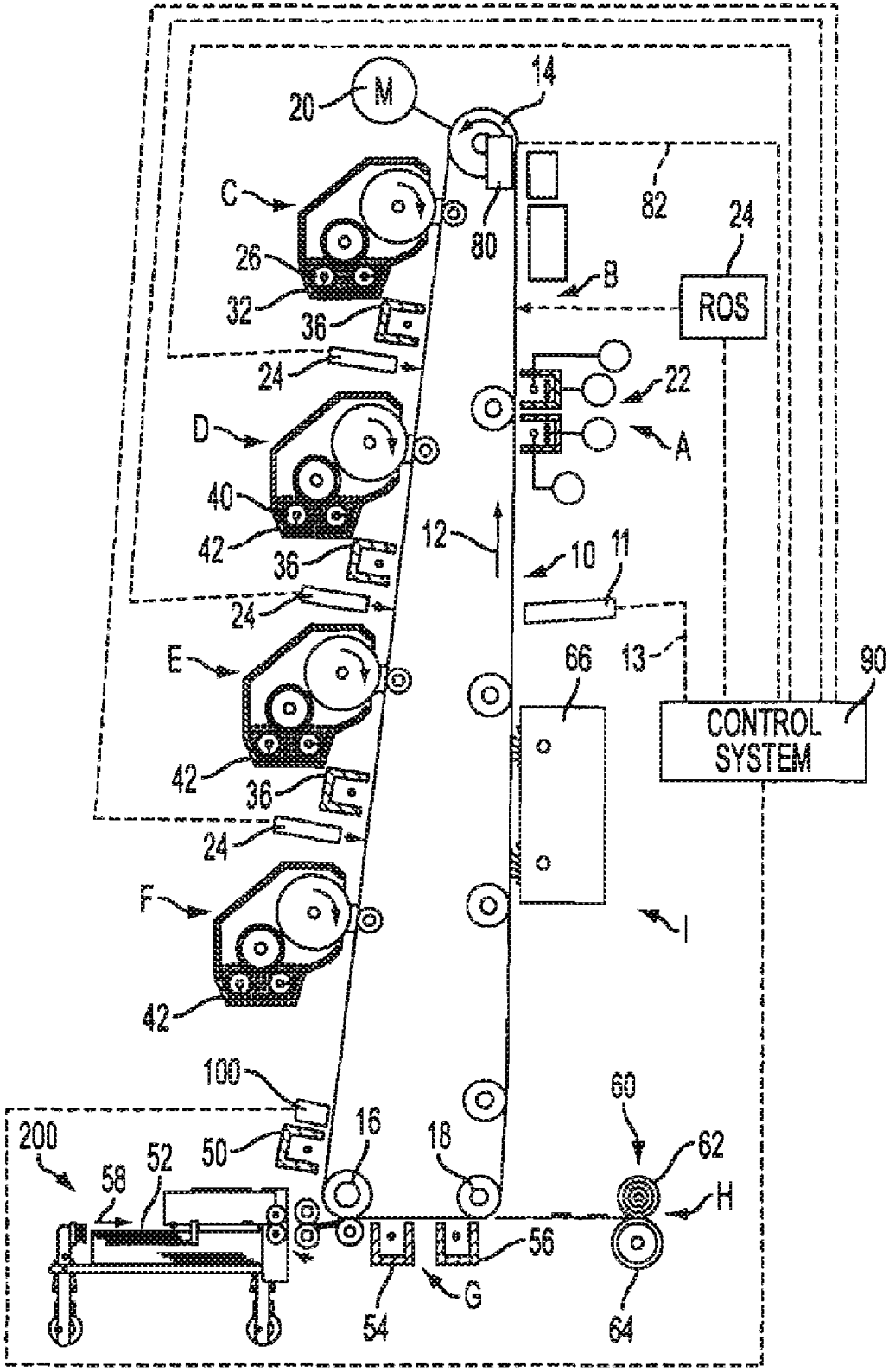
FIG. 1 is a schematic elevation view of a fall color image-on-image single-pass electrophotographic printing machine described herein.

Referring to FIG. 1, the printing machine of the exemplary embodiment uses a charge retentive surface in the form of an Active Matrix (AMAT) photoreceptor belt 10 supported for movement in the direction indicated by arrow 12, for advancing sequentially through various xerographic process stations. The belt is entrained about a drive roller 14, tension roller 16 and fixed rollers 18, and the drive roller 14 is operatively connected to a drive motor 20 for effecting movement of belt 11 through the xerographic process stations. Belt 10 has a seam that corresponds to a seam hole in the belt. In proximity to belt 10 is a seam hole sensor 11 that detects the passage of the seam hole as belt 10 moves in the direction indicated by arrow 12, and provides a seam hole signal 13 to control system 90.

A portion of belt 10 corresponding to an image area passes through charging station A where a corona generating device 22 charges the photoconductive surface of belt 10 to a relatively high, substantially uniform, preferably negative potential.

Next, the charged portion of belt 10 is advanced through an imaging/exposure station B. At imaging/exposure station B, control system 90 receives the image signals from controller 100 representing the desired output image, and processes these signals to convert them to the various color separations of the image which is transmitted to a laser based output scanning device 24 (imaging device 24), which causes the charged portion of belt 10 to be discharged in accordance with the output from the scanning device. Preferably scanning device 24 is a laser Raster Output Scanner (ROS) having a driving motor. Alternatively, the ROS could be replaced by other imaging devices and xerographic exposure devices such as LED arrays.

The charged portion of belt 10, which is initially charged to a voltage $V_O$, undergoes dark decay to a level $V_{ddp}$ equal to about −500 volts. When exposed at the exposure station B it is discharged to $V_{expose}$ equal to about −50 volts. Thus, after exposure, the charged portion of belt 10 contains a monopolar voltage profile of high and low voltages, the former corresponding to charged or background areas and the latter corresponding to discharged areas.

At a first development station C, developer structure 32, utilizing a hybrid scavengeless development (HSD) system, includes a development roll, better known as the donor roll, that is powered by two development fields (potentials across an air gap). The first development field is the AC jumping field that is used for toner cloud generation. The second development field is the DC development field that is used to control the amount of developed toner mass on belt 10. The toner cloud causes charged toner particles 26 to be attracted to the electrostatic latent image in the discharged portion of belt 10. Appropriate developer biasing is accomplished via a power supply. This type of system is a noncontact type in which only toner particles (black, for example) are attracted to the latent image and there is no mechanical contact between belt 10 and a toner delivery device to disturb a previously developed, but unfixed, image on the charged portion of belt 10.

The developed but unfixed image is then transported past a second charging device 36 where the charged portion of belt 10 is recharged to a predetermined level.

A second exposure/imaging is performed by imaging device 24 for station C which comprises a laser based output structure that is utilized for selectively discharging the charged portion of belt 10 on toned areas anchor bare areas, pursuant to the image to be developed with a second color toner. At this point, the charged portion of belt 10 contains toned and untoned areas at relatively high voltage levels and toned and untoned areas at relatively low voltage levels. These low voltage areas represent image areas that are developed using discharged area development (DAD). To this end, a negatively charged developer material 40 including color toner is employed. The toner, which by way of example may be yellow, is contained in developer structure 42 disposed at a second development station D and is presented to the latent images on the discharged portion of belt 10 by way of a second HSD system. A power supply (not shown) serves to electrically bias the developer structure to a level effective to develop the discharged image areas with negatively charged yellow toner particles 40.

The above procedure is repeated for a third image for a third suitable color toner such as magenta and for a fourth image and suitable color toner such as cyan at stations E and F, respectively. The exposure control scheme described below may be utilized for these subsequent imaging steps. In this manner a full color composite toner image is developed on the photoreceptor belt. The timing of the various imaging stations is sensed and controlled by the system as described below.

To the extent to which some toner charge is totally neutralized, or the polarity reversed, thereby causing the composite image developed on belt 10 to consist of both positive and negative toner, a negative pre-transfer dicorotron member 50 is provided to condition the toner for effective transfer to a substrate using positive corona discharge.

Subsequent to image development, a sheet of support material 52 is moved into contact with the toner images at transfer station G. Sheet 52 is advanced to transfer station C by the sheet feeding apparatus 200. Sheet 52 is then brought into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from belt 10 to sheet 52. A detack dicorotron 56 is provided for facilitating stripping of the sheets from belt 10.

After transfer, sheet 52 continues to move, in the direction of arrow 58, onto a conveyor which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 5 passes between fuser roller 62 and backup roller 64 with the toner powder image contacting fuser roller 62. In this manner, the toner powder images are permanently affixed to sheet 52. After fusing, a chute (not shown) guides the advancing sheets 52 to a catch tray, stacker, finisher or other output device (not shown), for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush or plural brush structure contained in a housing 66.

It is believed that the foregoing description is sufficient for the purposes of the present application to illustrate the general operation of a color printing machine.

As described above, image-on-image (IOI) single-pass xerographic systems are designed such that different colors are laid on top of each other all in one pass of photoreceptor belt 10. In order for this to happen, each color has its own image station that includes a charging device, a raster output scanner (ROS) or scanning and/or imaging device (that controls how the latent image is formed on the photoreceptor belt), a developer (that applies the colored toner to the latent image on the belt), and a belt hole sensor or controller that signals the imaging device to begin forming the image. Therefore, if an IOI single-pass system applies four colors, there will be four image stations, each consisting of a charge device, scanning and/or imaging device, developer and one or more belt hole sensors.

As stated above, the imaging device of each image station needs a timing signal to initiate the formation of the latent image at the right time for its respective color. Previously, this signal has been related to a series of fixed holes on the edge of the photoreceptor belt. As each belt hole approaches an image station, a belt hole sensor for that image station provides a signal to a controller that, in turn, provides an image initiation signal to cause the imaging device to begin forming the latent image on the belt in accordance with an image position established by the location of the belt hole. For ten pitch operation, there would be ten holes on the belt. The first hole would be larger than the others to signify the location of the seam on the belt. Such a system, however, does not allow the pitch of the belt to be changed.

Existing virtual belt hole systems use only the first belt hole in the belt to indicate the location of the belt seam, and thus do not require the presence of additional belt holes. Instead, existing virtual belt hole systems use the position of the first belt hole and the distance the belt moved after detection of the first belt hole, provided by an encoder, to provide coordinated signals though a controller that cause the imaging stations to initiate formation of latent images on the belt. Such systems allow the pitch of a belt to be varied, for example, based on the size of the copy sheets. However, as mentioned above, the image initiation signal based on the signal provided by the belt hole detector is not synchronized with a clock signal that controls the imaging stations. This non-synchronous system thus introduces a delay between the point when the controller provides the image initiation signal to an imaging station and the point when that imaging station detects the next clock count after receipt of the image initiation signal and executes the imaging process triggered by the image initiation signal. During this delay, the belt moves a certain distance and causes the formation of the image to be off slightly by at least the magnitude of the delay, resulting in reduction of image quality.

To minimize the effect of the delay, some IOI single-pass systems speed up and slow down (rephase) the motor for each imaging station to make the imaging stations individually approach synchronization with the each station's image initiation signal. Such changes to imaging station motor speed require significant time during which images are positionally unstable, impacting the minimum size of inter-document zones (inter-image areas), and reducing the efficiency of the xerographic system. At faster belt velocities, the rephase time equates to larger belt travel distances that require larger inter-image areas, and that further reduce the efficiency of the xerographic system.

To address the aforementioned problems with previous virtual belt hole systems, the present xerographic system uses the position of the first belt hole, detected by a belt hole sensor, and an elapsed time after the detection of the first belt hole, provided as a clock count from a timer or Master Clock, to control the location of images by all of the image stations on a photoreceptor belt. Because the clock counts provided by the Master Clock are used to determine when to initiate the imaging device of each image station, the control signal (the Master Clock signal) is synchronous for all the image stations, and thus no delay is required to compensate for asynchronicity between the initiation signal and the clock signal, as seen with the previous virtual hole systems.

Figure 2:
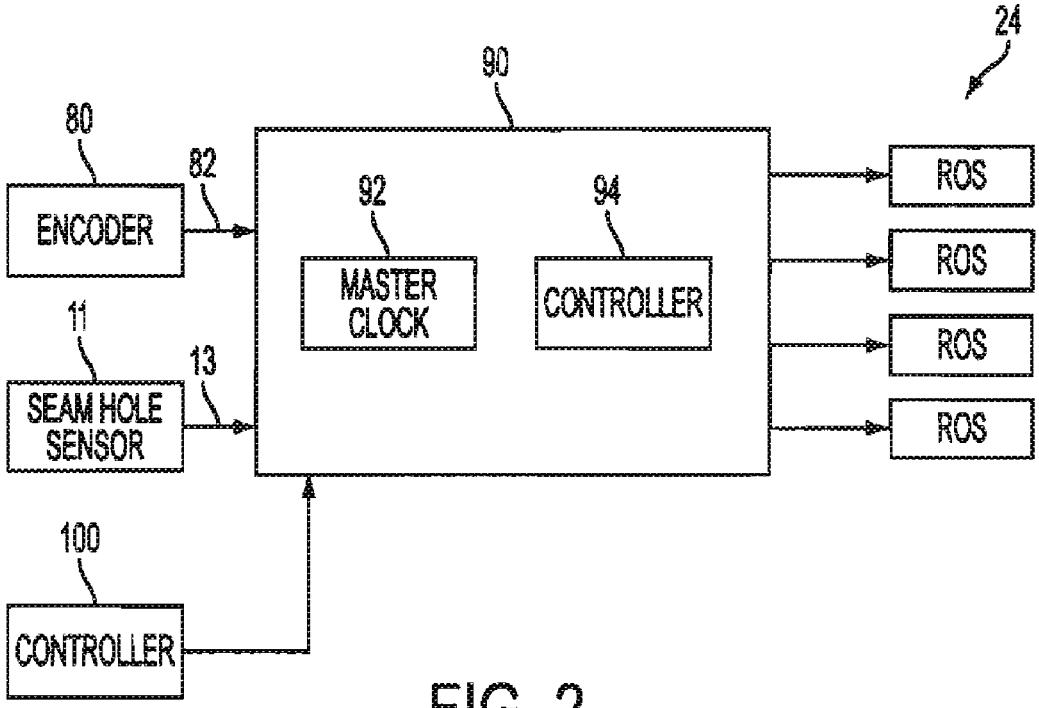
FIG. 2 is a graphical representation of the control system of the FIG. 1 embodiment.

Referring to FIG. 2, the control system 90 of the exemplary embodiment includes a Master Clock 92 that provides a clock signal, or clock counts, to the controller 94 and to the imaging devices 24 of each image station. The Master Clock 92 can also be provided external to the control system 90. The control system 90 is also provided with a signal 82 from the encoder 80, a seam hole signal 13 from the seam hole sensor 11, and a signal from the controller 100, as explained above for FIG. 1. As also explained above, the seam hole sensor 11 provides the seam hole signal 13 when the seam hole in the photoreceptor belt 10 is detected. After being provided with the seam hole signal 13, the controller 94 establishes the next clock count, or a suitable subsequent clock count, output by Master Clock 92, as a reference point corresponding to the location of the seam of the photoreceptor belt 10. The controller 94 then waits for a specified number of clock counts until providing an image initiation signal for a particular color component image of a particular multi-color image to the imaging device 24 of the appropriate image station, and the signaled imaging device then initiates an image forming process. This process is repeated for the remaining imaging stations for the appropriate number of images until the belt hole sensor again identifies the location of the belt seam and reestablishes the reference point for use with the next cycle of the belt. (For example, if the belt has a pitch of five, and the print job has five or more multi-color images, each image station would be initiated five times during one cycle of the belt to form 5 IOI toner images.) Each of the image initiation signals provided by control system 90 is based on the clock counts provided by Master Clock 92 and thus each is synchronous with control signals provided to the imaging devices 24, which operate in accordance with the same clock counts provided by master Clock 92. Accordingly, there is no delay between the image initiation signal and the next clock count of the imaging devices, as experienced with prior systems.

The control system 90 includes a microprocessor that is programmed with firmware, however, it is also possible to perform the same function with a software application. The board assembly also has hardware to read inputs into the microprocessor and hardware to allow the microprocessor to produce outputs. The Master Clock 92 also provides a signal to other time-dependent xerographic systems requiring a clock signal. Another input to the control system 90 is signal 82 provided by encoder 80 for encoder feedback. Encoder 80 is attached to a roller on photoreceptor belt 10 and signal 82 is used for motion control algorithms. Based on the encoder output, the speed of photoreceptor 10 is precisely controlled and maintained substantially constant.

Figure 3:
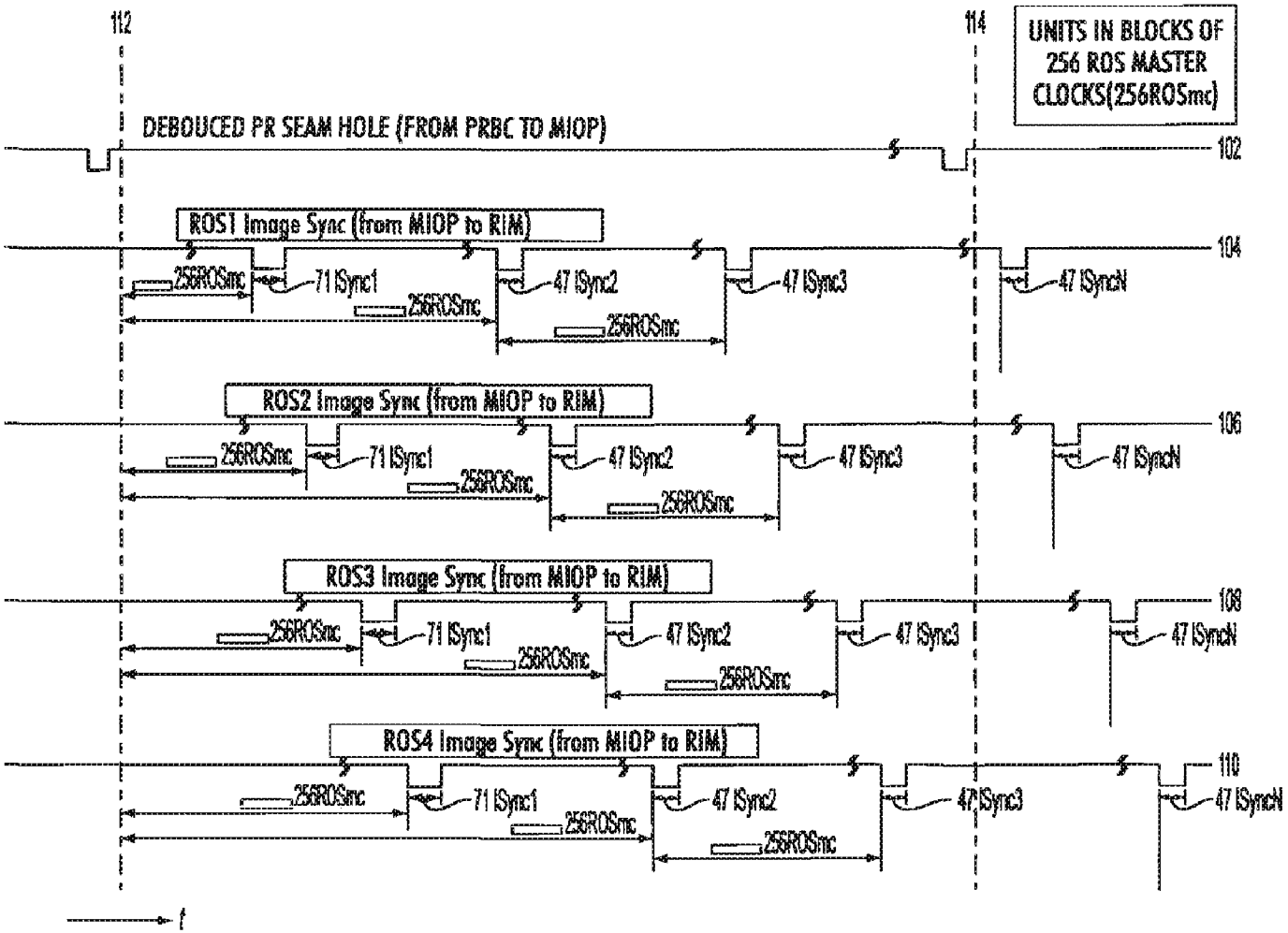
FIG. 3 is a graphical representation of the relationship between the signals corresponding to the seam hole and each imaging station.

FIG. 3 represents the operation of control system 90 over time t corresponding to the clock count provided by Master Clock 92. Line 102 corresponds to the seam hole signal 13 provided to control system 90 by seam hole sensor 11. After receiving the seam hole signal 13, indicated by a change in line 102, controller 94 sets a subsequent clock count as a reference point, indicated by vertical dotted lines. In the representation provided in FIG. 3, first reference point 112 is provided after the first change in line 102 and a second reference point 114 is provided after the second change in line 102. Reference points 112 and 114 mark the beginnings of respective cycles of the photoreceptor belt 10.

After controller 94 sets first reference point 112, the Master Clock 92 continues to provide clock counts to controller 94 and to each ROS 24, represented by lines 104, 106, 108, and 110. As the speed of photoreceptor belt 11 is nearly constant, each clock count relates to a certain distance traveled by photoreceptor belt 10. Controller 100 provides layout data to control system 90 indicating the spacing to be implemented by control system 90 when providing image initiation signals to each ROS 24. The layout data can be distances required to form image areas on photoreceptor belt 10 and distances required between each adjacent image area on belt 10, and control system 90 can convert the distances to a corresponding clock count. The layout data can also be provided to control system 90 as a value that is a time, or as a clock count that does not require conversion.

The layout data corresponds to the number of clock counts required before control system 90 provides an image initiation signal to each ROS 24. As shown in FIG. 3, for line 104, an image initiation signal is provided by controller 94 to a first ROS 24, identified as ROS1, at a clock count based on first reference point 112 and identified as ISinc1, which lasts for 71 clock counts. Another subsequent image initiation signal Isinc2 is provided again to ROS1 at a clock count based on first reference point 112, and again for Isync 3. Similarly arranged image initiation signals are provided, based on different clock counts, for each of lines 106, 108 and 110. FIG. 3 thus corresponds to a photoreceptor belt having a pitch of three because three image initiation signals are provided for a single cycle of belt 10 between reference points 112 and 114.

Variations in the timing or recognition of the seam hole signal 13 are eliminated because the seam hole signal is made to correspond to a reference point that is a clock count of Master Clock 92. For each image initiation signal represented in FIG. 3, the image initiation signal provided to each ROS 24 is synchronous with the Master Clock 92 because each is based on reference point 112 and a specified number of clock counts from the Master Clock. Accordingly, the operation of each ROS is synchronous to the seam hole signal, and there is no delay requiring alteration to the operation of any ROS.

Furthermore, the operation of the electrophotographic printing machines using the exemplary control system and method are not limited by the time required to adjust the operation of a ROS, permitting faster and more efficient operation. The exemplary system and method also allow a more accurate and efficient placement and detection of chevrons on belt 10.

The exemplary embodiment is also designed to require as few download parameters as possible when determining the layout data to be used by control system 90. The following table lists parameters that can be downloaded as layout data to an exemplary embodiment of control system 90 having a pitch of 10, i.e., 10 image areas for each cycle of photoreceptor belt 10. By using the parameters described in TABLE 1, the timing of the image initiation signals relative to the seam hole (set to correspond to a reference point based on a clock count) can be calculated.

TABLE 1

| Parameter Downloads Used to Generate ROS Master Clock Image Sync Signals | | | |
|---|---|---|---|
| Parameter for Image Sync Generation | Layout Value (mm) | Clock Count Value (256 ROS MC) | Comments |
| Constant Parameters | | | |
| SeamSensor__To__ROS1 | −46.8000 | −553.0 | |
| Seam__Hole__Length | 6.0000 | 71.0 | = PRBeltSeamHoleLength = 6 mm |
| Belt__Hole__Length | 4.000 | 47.0 | = 6.0 − 2.0 |
| Variable Parameters (at Cycle Up) | | | |
| PREnc__ScalingFactor | 1.00097 | | = 3111/ NVM4652__prBeltModEncoderFreq |
| ROS__To__ROS__UnitDistance | 308.0470 | 3642.0 | ROS2 To ROS3 and ROS3 To ROS 4 = ROUND(308.047/(84.6667/1000) * PREnc__ScalingFactor, 0) |
| ROS1__To__ROS2__Distance | 616.0940 | 7284.0 | = ROUND(308.047*2/ (84.6667/1000) * PREnc__ScalingFactor, 0) |
| Variable Parameters (with Print Mode Change) | | | |
| TESeamHoleDB__To__LEImageSync1 | 331.8000 | 3923.0 | = 347.60 + PRBeltSeamZoneLengthPitch# − PRBeltRephaseDistancePitch# − 8.0 − 7.0 − 6.0 + NVM21965__PEGImageShiftTotalmm |
| TESeamHoleDB__To__LEImageSync2 | 743.5000 | 8790.0 | = 347.60 + PRBeltSeamZoneLengthPitch# + 36.40 + Pitch#MaximageLength − 8.0 − 7.0 − 4.0 + NVM21965__PEGImageShiftTotalmm |
| Image__To__Image | 265.9000 | 3144.00 | = Pitch#MaximageLength + 32.40 |
| Image__Per__Rev | 10 | | |

The above parameters can be downloaded to the controller prior to the detection of a seam. All values are buffered since different imaging/exposure stations will often be working on different belt revolutions. Newly downloaded pitch information will take place on the next belt revolution for each imaging/exposure station regardless of when the information is received.

As shown in Table 1 and FIG. 3, the speed of the Master Clock may be different from the speed of the ROS, thus requiring the use of a scaling factor of 256, for example. Another scaling factor may also be applied to the Master Clock signal, a ROS signal, or to the image initiation signal to account for variations in average photoreceptor belt velocities.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A system for controlling imaging devices in a single-pass multi-color electrographic printing machine, comprising:

a photoconductive member having a timing member, the photoconductive member moving along a path in the printing machine;

a plurality of imaging devices, each one of the plurality of imaging devices forming a latent image on the photoconductive member when provided a timing signal;

a sensor to sense the timing member in the photoconductive member as the timing member passes the sensor and to generate a sensor signal; and a controller that generates the timing signal for each of the plurality of imaging devices based on the sensor signal and a clock signal generated by a clock signal generating device, the generation of the timing signal not being based on an encoder signal, the controller being external to the plurality of imaging devices.

2. The system of claim 1, wherein the timing signal is synchronous with the clock signal.

3. The system of claim 1, wherein the sensor signal is converted into a reference point that is synchronous with both the timing signal and the clock signal.

4. The system of claim 1, wherein the timing signal is generated independently of an encoder signal provided by an encoder corresponding to a movement of the photoconductive member.

5. The system of claim 1, wherein the timing signal is not derived from an encoder signal provided by an encoder that is coupled to movement of the photoconductive member.

6. The system of claim 1, wherein the timing member is an aperture in the photoconductive member, the sensor senses the aperture and the sensor signal is an aperture signal.

7. A method for controlling imaging devices in a single-pass multi-color electrographic printing machine, comprising:

sensing a timing member in a photoconductive member moving along a path in the printing machine to generate a sensor signal;

generating a timing signal for each of a plurality of imaging devices of the printing machine based on the sensor signal and a clock signal generated by a clock signal generating device, the generation of the timing signal not being based on an encoder signal; and providing the timing signals to the plurality of imaging devices, the plurality of imaging devices forming latent images on the photoconductive member when provided the timing signals, wherein the timing signals are generated externally of the plurality of imaging devices.

8. The method of claim 7, wherein the timing signal is synchronous with the clock signal.

9. The method of claim 7, further comprising converting the sensor signal into a reference point synchronous with the clock signal.

10. The method of claim 7, further comprising providing an encoder signal from an encoder corresponding to movement of the photoconductive member, wherein the timing signal is generated independently of the encoder signal.

11. The method of claim 7, further comprising providing an encoder signal from an encoder coupled to movement of the photoconductive member, wherein the timing signal is not derived from the encoder signal.

12. A xerographic device including the system of claim 1.

13. The method of claim 7, wherein the electrographic printing machine is a xerographic device.

14. An imaging apparatus comprising:

a photoconductive member having a timing indicator, the photoconductive member moving along a path in the imaging apparatus, the movement of the photoconductive member being monitored by an encoder mounted near the photoconductive member, the encoder generating an encoder signal based on the movement of the photoconductive member;

at least one imaging device forming a latent image on the photoconductive member when provided a timing signal;

a sensor to sense the timing indicator in the photoconductive member as the timing indicator passes the sensor and to generate a sensor signal; and a controller that generates the timing signal for the at least one imaging device based on the sensor signal and a clock signal generated by a clock signal generating device, and the generation of the timing signal is not based on the encoder signal.

15. The imaging apparatus of claim 14, wherein the timing signal is synchronous with the clock signal.

16. The imaging apparatus of claim 14, wherein the sensor signal is converted into a reference point that is synchronous with both the timing signal and the clock signal.

17. The imaging apparatus of claim 14, wherein the timing indicator is an aperture in the photoconductive member, the sensor senses the aperture and the sensor signal is an aperture signal.

18. A imaging apparatus of claim 14, wherein the imaging apparatus is a xerographic device.

19. The system of claim 2, wherein the synchronization of the timing signal and the clock signal includes an adjustment factor.

20. The method of claim 8, wherein the synchronization of the timing signal and the clock signal includes an adjustment factor.

* * * * *